US012593884B2

(12) United States Patent
Busch

(10) Patent No.: US 12,593,884 B2
(45) Date of Patent: Apr. 7, 2026

(54) SUPPORT RAIL FOR ATTACHMENT OF HELMET ACCESSORY TO A HELMET, AS WELL AS HELMET ACCESSORY, SUPPORT SYSTEM AND HELMET

(71) Applicant: Busch PROtective Germany GmbH & Co. KG, Guetersloh (DE)

(72) Inventor: Edwin Busch, Guetersloh (DE)

(73) Assignee: Busch PROtective Germany GmbH & Co KG, Guetersloh (DE)

( * ) Notice: Subject to any disclaimer, the term of this patent is extended or adjusted under 35 U.S.C. 154(b) by 0 days.

(21) Appl. No.: 18/139,517

(22) Filed: Apr. 26, 2023

(65) Prior Publication Data

US 2023/0346064 A1 Nov. 2, 2023

(30) Foreign Application Priority Data

Apr. 28, 2022 (DE) ..... 10 2022 110 400.1
Feb. 27, 2023 (EP) ..... 23158713

(51) Int. Cl.
*A42B 3/00* (2006.01)
*A42B 3/04* (2006.01)

(52) U.S. Cl.
CPC ..... *A42B 3/0406* (2013.01); *A42B 3/044* (2013.01)

(58) Field of Classification Search
CPC ..... A42B 3/0406; A42B 3/04; F16M 13/00; F41H 1/04; F41G 11/003
See application file for complete search history.

(56) References Cited

U.S. PATENT DOCUMENTS

| | | | | |
|---|---|---|---|---|
| 4,042,974 | A * | 8/1977 | Morgan | A42B 3/326 2/9 |
| 4,788,724 | A * | 12/1988 | Lazzeroni | H04R 1/08 379/430 |
| 8,800,194 | B2 * | 8/2014 | Teetzel | F41G 11/003 42/124 |
| 9,433,252 | B2 * | 9/2016 | Lebel | A42B 3/04 |
| 10,299,528 | B2 * | 5/2019 | Dextraze | F16M 13/04 |
| 11,452,328 | B2 * | 9/2022 | Franzino | A42B 3/042 |
| D1,042,980 | S * | 9/2024 | Hanudel | D29/122 |
| 12,108,824 | B2 * | 10/2024 | Hunt | A42B 3/04 |
| 12,364,302 | B2 * | 7/2025 | O'Connell | A62B 18/084 |
| 12,408,718 | B2 * | 9/2025 | Teetzel | A42B 3/04 |
| 2013/0191967 | A1 * | 8/2013 | Harris | A42B 3/04 2/243.1 |
| 2014/0020159 | A1 | 1/2014 | Teetzel et al. | |

(Continued)

*Primary Examiner* — Richale L Quinn
(74) *Attorney, Agent, or Firm* — Scully, Scott, Murphy & Presser, P.C.

(57) ABSTRACT

A support rail for attachment of a helmet accessory to a helmet. The support rail including: a top side; a first receiving side; and a second receiving side. The top side has an attachment portion configured to be fixed to a bottom side of the helmet. The first receiving side having a first retaining groove and the second receiving side having a second retaining groove. The first retaining groove and the second retaining groove are configured to receive one or more engagement elements of a helmet accessory. The attachment portion, the first retaining groove and the second retaining groove extend in a longitudinal direction of the support rail and a first groove valley of the first retaining groove and a second groove valley of the second retaining groove are aligned towards each other.

17 Claims, 6 Drawing Sheets

(56) References Cited

U.S. PATENT DOCUMENTS

| | | | | |
|---|---|---|---|---|
| 2014/0082991 | A1* | 3/2014 | Clark | F41G 1/35 42/146 |
| 2014/0223645 | A1* | 8/2014 | Rogers | A42B 3/0406 2/422 |
| 2018/0279711 | A1* | 10/2018 | Szalkowski | A42B 3/32 |
| 2021/0112902 | A1* | 4/2021 | Rogers | A42B 3/0406 |
| 2021/0177114 | A1* | 6/2021 | Roth | A42B 3/0406 |
| 2021/0244122 | A1* | 8/2021 | O'Connell | F41H 1/04 |
| 2022/0357126 | A1* | 11/2022 | Hjertberg | F41C 27/00 |
| 2024/0164464 | A1* | 5/2024 | Teetzel | A42B 3/04 |
| 2024/0315372 | A1* | 9/2024 | Teetzel | A42B 3/04 |
| 2024/0349837 | A1* | 10/2024 | Teetzel | A42B 3/30 |
| 2024/0356143 | A1* | 10/2024 | Teetzel | H02J 7/0045 |
| 2024/0407493 | A1* | 12/2024 | Teetzel | A42B 3/04 |
| 2025/0089835 | A1* | 3/2025 | Hanudel | A42B 3/326 |

* cited by examiner

SUPPORT RAIL FOR ATTACHMENT OF HELMET ACCESSORY TO A HELMET, AS WELL AS HELMET ACCESSORY, SUPPORT SYSTEM AND HELMET

CROSS-REFERENCE TO RELATED APPLICATION

The present application is based upon and claims the benefit of priority from DE 10 2022 110 400.1 filed on Apr. 28, 2022, and EP 23 158 713.0 filed on Feb. 27, 2023, the entire contents of each of which is incorporated herein by reference.

BACKGROUND

Field

The present disclosure relates to helmets and more particularly to a support rail for attachment of a helmet accessory to a helmet. In addition, the present disclosure relates to a helmet accessory, a support system and a helmet.

Prior Art

Helmets, such as protective helmets, are worn in a variety of different professions and activities. For example, different types of protective helmets are used by police officers, firefighters and soldiers. Helmets are also used in sports, e.g., as bicycle helmets. Often, people wearing such helmets carry other items of equipment that are required for the respective activities. Such items of equipment are, for example, lamps, glasses, visors, night vision gear, radios, headphones and similar items.

It is known to provide rails on helmets to which such items of equipment can be attached so that a user can keep his hands free. In many cases, these rails are screwed laterally to the helmet shells and have attachment elements with which various helmet accessories, such as the aforementioned items of equipment, are fixable to the rail and thus to the helmet.

FIG. 1 shows a schematically simplified helmet 2, which is configured as a protective helmet in the example shown. The helmet 2 includes a helmet shell 4 with a bottom side 6. For attachment of the helmet 2 to the head of a wearer, the helmet 2 comprises a belt system 3. In addition, a rail 7 is screwed tightly laterally onto the helmet shell 4 with which various helmet accessories, such as lamps, visors, radios and similar accessory, are fixable to the helmet 2. For this purpose, the rail 7 includes attachment elements 8, for example in the form of a groove, into which the helmet accessory can be inserted, so that the helmet accessory does not have to be carried manually by the wearer. Such rails 7 are known in the art, but require the helmet accessory to be precisely matched to the attachment elements 8 provided.

Further, such rails laterally screwed to the helmet are laborious to attach to the helmet, since several holes must be introduced into the helmet shell for support. In addition, the flexibility of such rails is limited, since only such helmet accessory is fixable to the helmet for that suitable attachment elements are provided on the rail.

SUMMARY

An object is to make handling of the attachment of a helmet accessory to a helmet more flexible and easier.

Such object can be achieved by a support rail for attachment of a helmet accessory to a helmet, wherein the support rail includes a top side, a first receiving side and a second receiving side, wherein the top side of the support rail has an attachment portion which is configured to fix the support rail to a bottom side of the helmet, wherein a first retaining groove is formed in the first receiving side and wherein a second retaining groove is formed in the second receiving side, wherein the first retaining groove and the second retaining groove are configured to receive engagement elements of a helmet accessory, wherein the attachment portion, the first retaining groove and the second retaining groove extend in a longitudinal direction of the support rail, wherein a groove valley of the first retaining groove and a groove valley of the second retaining groove are aligned towards each other.

Such support rail can be easily fixed to a helmet and with which the helmet accessory is quickly and flexibly attachable in the retaining grooves of the support rail and thus to the helmet.

The attachment portion on the top side allows the support rail to be fixed to the bottom side of the helmet. Attachment of the support rail to the bottom side of the helmet can be performed quickly and easily and at the same time maintains the helmet accessory securely on the helmet. The support rail can be configured to be fixed to a bottom edge of a helmet shell of the helmet. The attachment portion can be configured to abut against the bottom side of the helmet, such as against the bottom edge of the helmet shell. The attachment portion can be configured to receive a portion, such as a side portion, of the bottom side of the helmet. The attachment portion and/or the support rail can be curved in the longitudinal direction, wherein a curvature of the attachment portion and/or of the support rail can follow a curvature of the bottom edge of the helmet shell.

The longitudinal direction can be understood to be a direction from a front end to a rear end of the support rail. The front end of the support rail can be aligned toward a front end of the helmet and the rear end of the support rail can be aligned toward the rear end of the helmet when the support rail is fixed to the helmet. If the bottom side of the helmet has a curvature, the longitudinal direction can also follow this curvature. The support rail can be configured to extend longitudinally along the longitudinal direction.

The first retaining groove and the second retaining groove can be arranged towards each other such that their respective groove valleys are aligned towards each other. Groove valleys can be understood to be the lowest and/or deepest portions of the retaining grooves. The groove openings of the first retaining groove and of the second retaining groove can point away from each other. In this way, it is possible to engage both retaining grooves with engagement elements, being, for example, hook-shaped, in order to brace the helmet accessory between the retaining grooves, so that the helmet accessory is securely fixed to the support rail.

The first receiving side and the second receiving side can be arranged towards each other such as at an angle of 60° to 120°, or 75° to 105°, such as 90°. The top side, the first receiving side and the second receiving side can be configured along a transverse circumference of the support rail. The transverse circumference can be a circumference around the support rail running transversely to the longitudinal direction.

Each of the first retaining groove and/or the second retaining groove can include edges delimiting a first groove surface from a second groove surface. Each of the groove surfaces of the first retaining groove and/or of the second retaining groove can include a first groove side surface, a groove base surface and a second groove side surface, which can adjoin each other at an edge, respectively. According to an embodiment, the groove surfaces of the first retaining groove and/or of the second retaining groove can be configured as straight surfaces. Each of the first retaining groove and/or the second retaining groove can include two groove side surfaces aligned parallel to each other. The shape of the first retaining groove and/or of the second retaining groove can be rectangular. According to another embodiment, each of the first retaining groove and/or the second retaining groove can include one or more curved groove surfaces.

The attachment portion can be configured as an attachment groove.

Due to the configuration of the attachment portion as an attachment groove, the support rail can be attached onto the bottom edge of the helmet. The attachment groove can be introduced into the top side of the support rail. The attachment groove can be configured to be complementary in shape to the bottom edge of the helmet shell. The attachment groove can be deeper than the first retaining groove and/or the second retaining groove. The attachment groove can extend through at least half of a material thickness of the support rail. In this way, the support rail can be fixed tightly to the helmet.

At least one groove side surface of the first retaining groove and at least one groove side surface of the second retaining groove can be arranged towards each other at an angle of 60° to 120°, such as 75° to 105°, or 85° to 95°.

Where the groove side surfaces of the different retaining grooves at an arrangement towards each other at an angle of 60° to 120°, the helmet accessory can be securely braced in the retaining grooves. The at least one groove side surface of the first retaining groove and the at least one groove side surface of the second retaining groove can be arranged towards each other at an angle of 90°. Alternatively, at least one groove side surface of the first retaining groove and at least one groove side surface of the second retaining groove can be arranged towards each other at an angle of 150° to 210°, such as 165° to 195°, or 175° to 185°.

The orientation of a groove side surface can be indicated in relation to an orientation of the groove opening and/or of the groove valley of the respective retaining groove. Accordingly, for example, an orientation of two groove side surfaces to each other at an angle of 180° means that the groove side surfaces are generally aligned parallel to each other, but the groove openings of the respective grooves point in opposite directions.

A groove side surface of the first retaining groove and an adjacent groove side surface of the second retaining groove can be arranged towards each other at an angle of 60° to 120°. By configuring mutually adjacent groove side surfaces in this angular range, two engagement elements of a helmet accessory can engage in the two retaining grooves and can be braced against each other, for example, by a compressing elastic action of force in the retaining grooves. Alternatively or additionally, the groove side surface of the first retaining groove, which is furthest away from the second retaining groove, can be aligned at an angle of 60° to 120° to the groove side surface of the second retaining groove which is furthest away from the first retaining groove. Due to the groove side surfaces being configured to be spaced apart from each other in such angular range, the engagement elements can be braced against each other by an expanding elastic action of force.

At least one groove base surface of the first retaining groove and at least one groove base surface of the second retaining groove can be arranged towards each other at an angle of 60° to 120°, such as 75° to 105°, or 85° to 95°. Likewise, with an orientation of the groove side surfaces of different retaining grooves towards each other, a good bracing of engagement elements of the helmet accessory can be achieved with an orientation of the groove base surfaces towards each other.

The support rail can include a third receiving side having a third retaining groove, which can extend in the longitudinal direction of the support rail.

In addition to the attachment portion, the support rail according to this embodiment can include three retaining grooves. This allows for a particular flexible attachment of the helmet accessory. Also, the third receiving side can be configured along the transverse circumference of the support rail. The third receiving side can be adjacent to the first receiving side and/or the second receiving side. A shape of the third retaining groove can correspond to a shape of the first retaining groove and/or of the second retaining groove. The first retaining groove can be parallel to the second retaining groove and/or to the third retaining groove.

The at least one groove side surface of the second retaining groove and at least one groove side surface of the third retaining groove can be arranged towards each other at an angle of 60° to 120°, wherein the at least one groove side surface of the first retaining groove and the at least one groove side surface of the third retaining groove can be arranged towards each other at an angle of 150° to 210°.

Such orientation of the groove side surfaces allows the helmet accessory to be flexibly braced in the retaining grooves. For example, the helmet accessory can be braced in the first and second retaining grooves, the second and third retaining grooves, or the first and third retaining grooves. The at least one groove side surface of the second retaining groove and the at least one groove side surface of the third retaining groove can be arranged towards each other at an angle of 75° to 105°, such as 85° to 95°, or 175° to 90°. The at least one groove side surface of the first retaining groove and the at least one groove side surface of the third retaining groove can be arranged towards each other at an angle of 165° to 195°, such as 175° to 185°, or 175° to 180°.

The groove side surfaces of the first retaining groove can be configured parallel to each other. Likewise, the groove side surfaces of the second retaining groove can be configured parallel to each other. Further, the groove side surfaces of the third retaining groove can be configured parallel to each other.

The support rail can comprise four or more sides along a transverse circumference, wherein each of the top side, the first receiving side and the second receiving side, and the third receiving side, can form one of the four or more sides.

A configuration of the support rail with four sides allows for easy handling and easy attachment of the helmet accessory. The top side and/or the first receiving side and/or the second receiving side and/or the third receiving side can be configured as straight sides. An angle between the top side and the first receiving side and/or an angle between the first receiving side and the second receiving side and/or an angle between the second receiving side and the third receiving side and/or an angle between the third receiving side and the top side can be between 60° and 120°, such as between 75° and 105°, or 90°.

The first receiving side can be an outer side and the second receiving side can be a bottom side of the support rail, wherein the third receiving side can be an inner side of the support rail.

When the support rail is attached to the helmet, the outer side of the support rail can point outward, thus away from a head of a wearer of the helmet, and the inner side of the support rail can point inward, thus toward the head of the wearer. Thus, a retaining groove for fixing the helmet accessory can be located on the inner side, on the bottom side and on the outer side of the support rail, respectively.

The support rail can include at least one bore for receiving a fixing element, by which the support rail can be fixable to the helmet, wherein the at least one bore can be configured in an abutting surface which projects from the top side of the support rail and is configured to abut against an outer side of a helmet shell of the helmet.

Due to the fixing element, the support rail can be fixed to the helmet in addition to the attachment portion. As a result, the support rail can adhere more securely to the helmet. The fixing element can be a screw. A helmet accessory can be fixable to the helmet, by fixing the helmet accessory to the support rail by the same fixing element with which the support rail is also fixed to the helmet. The support rail can include at least two bores, for each of which a fixing element is provided.

The attachment portion can be configured to be complementary in shape to a side portion of the bottom side of the helmet shell of the helmet, wherein the upper side of the support rail can be configured with a curvature, which can follow a curvature of the side section of the bottom side of the helmet shell.

The configuration of the attachment portion can allow the support rail to be attached laterally to the helmet with little effort.

The first retaining groove and/or the second retaining groove, and/or the third retaining groove can comprise an undercut.

Such an undercut can narrow the groove opening with regard to the lower portions of the retaining grooves and can thus facilitate a bracing of the helmet accessory in the retaining grooves.

The support rail can be made of aluminum or can include aluminum. Aluminum is stable and light and is easy to machine.

The support rail can include a receiving component made of aluminum and at least one attachment component made of a plastic, wherein the first retaining groove and the second retaining groove can be configured in the receiving component, wherein the attachment component can be arranged in the attachment portion and fixed to the receiving component, wherein the attachment component can extend upward from the receiving component. The attachment component can be inserted into the receiving component, such as by at least one stud, which can engage laterally in a hole of the receiving component. The hole can be configured as a blind hole or a through borehole in the receiving component. In the attached state, the attachment component can be located at least partially, with a portion having the stud, between the receiving component and the helmet shell. By supporting the attachment component laterally against the receiving component, the helmet shell prevents that the stud can be detached from the hole, so that the attachment component adheres securely on the receiving component. If, on the other hand, the support rail is removed from the helmet shell, the attachment component can be separated easily from the receiving component.

The at least one attachment component can be arranged in the attachment portion such that it abuts against an inner side and/or an outer side of the helmet shell when the support rail is fixed to the helmet shell. For example, a first attachment component can abut against the inner side and a second attachment component can abut against the outer side of the helmet shell. The attachment component can form at least part of a wall of the fastening groove. The attachment component can be configured to fix the support rail to the helmet shell. The attachment component can include the abutting surface by which the support rail is fixable to the helmet. The abutting surface can be a flat component, which can comprise the bores for receiving the fixing element. The attachment component can be thinner than other parts of the support rail. For thin surfaces, plastic can be used rather than aluminum, since thin plastic surfaces may be more break-resistant. The attachment surface can be configured to fix the helmet accessory, such as, on the inner side of the helmet shell.

Such object is also achieved by a helmet accessory, including a first retaining arm with a first engagement element, such as hook-shaped, which can be configured to engage into the first retaining groove and/or the second retaining groove and/or the third retaining groove of a support rail according to one of the embodiments discussed above.

The helmet accessory can embody similar advantages, features and properties as the support rail described above.

Helmet accessory is understood to include, for example, a visor, safety glasses, a night vision gear, a lamp, a radio device, headphones or a support for another helmet accessory. Due to the first engagement element, which can be configured on the first retaining arm, the helmet accessory can be fixed quickly and easily in one of the retaining grooves and in this way attached to the helmet. Due to a hook-shaped configuration, the engagement element can adhere securely in the retaining groove.

The first retaining arm can comprise a second engagement element, such as hook-shaped, wherein the second engagement element and the first engagement element can be arranged towards each other at an angle of 60° to 120° or 150° to 210°.

Due to the second engagement element, the helmet accessory can engage into two of the retaining grooves and in this way can be clamped between the retaining grooves, so that the helmet accessory adheres particularly securely on the helmet. The second engagement element and the first engagement element can be arranged towards each other at an angle of 75° to 105° or 165° to 195°, furthermore at an angle of 85° to 95° or 175° to 185°, furthermore at an angle of 90° or 180°. The second engagement element can be arranged on the first retaining arm such as being spaced apart from the first engagement element.

According to an embodiment, the helmet accessory can include a retaining frame connected to the first retaining arm, the retaining frame can comprise attachment elements for fixing a further helmet accessory for a helmet.

The retaining frame can offer the possibility for receiving a further helmet accessory by the attachment elements being arranged on the retaining frame. This can be used for the helmet accessory that does not comprise engagement elements for attaching in the retaining grooves of the support rail. The attachment elements can include, for example, rails, eyelets or similar elements, which are usually provided for attachment of the helmet accessory to helmets. The first engagement element can be arranged at a first end of the retaining arm and the retaining frame can be arranged at the second end of the retaining arm. If, in addition, a second engagement element can be provided, which can be arranged between the first engagement element and the retaining frame on the first retaining arm.

The helmet accessory can include a second retaining arm, which can comprise a third engagement element, such as hook-shaped, and a fourth engagement element, such as hook-shaped.

Due to the second retaining arm, the helmet accessory can be fixed to the support rail in a twist-proof manner. The second retaining arm can be arranged offset to the first retaining arm in the longitudinal direction when the helmet accessory is fixed to the support rail. The angles at which the third engagement element and the fourth engagement element are arranged towards each other can correspond to the angle at which the first engagement element and the second engagement element are arranged towards each other.

The first retaining arm, and/or the second retaining arm, can be configured to be elastic.

Due to such elastic configuration of the retaining arms, the helmet accessory can be braced particularly well in the retaining grooves of the support rail. The engagement elements can be configured to be elastic.

The engagement elements can be braced in the retaining grooves by at least one side surface of the engagement element abutting against at least one of the groove side surfaces of the retaining groove and/or a base surface of the engagement element abutting against a groove base surface of the retaining groove. Due to such arrangement of the groove side surfaces and/or groove base surfaces of the different retaining grooves towards each other, the engagement elements can be securely held in the retaining grooves in this way. The fixation of the helmet accessory to the support rail takes place by positive locking and/or bracing, such as by utilization of an elasticity of the helmet accessory.

The first engagement element and the second engagement element of the helmet accessory can be arranged to each other such as in a braced state, when the helmet accessory is fixed to the support rail. In the braced state, a distance and/or an arrangement of the first engagement element to the second engagement element can differ from a separated state. In the separated state, the helmet accessory is not fixed to the support rail and the engagement elements are not under tension. On the other hand, the engagement elements are under tension to each other in the braced state.

Such object can be further achieved by a support system including a support rail according to one of the embodiments discussed above and a helmet accessory according to one of the embodiments discussed above, wherein the helmet accessory is detachably fixable to the support rail by fixing the first engagement element in the first retaining groove and/or the second retaining groove.

The support system can embody similar advantages, features and properties as the support rail described above and the helmet accessory described above.

When the helmet accessory is detachably fixed to the support rail, the first engagement element and the second engagement element can be introduced into the grooves such that the first engagement element and the second engagement element are under tension. This can be achieved by the elastic configuration of the first retaining arm and/or of the engagement elements.

In addition, such object can be achieved by a helmet, such as a protective hello met, including a support rail according to one of the embodiments discussed above, and a helmet accessory according to one of the embodiments discussed above, wherein the support rail is fixable or is fixed to a bottom side of a helmet shell of the helmet.

The helmet can embody similar advantages, features and properties as the support rail described above and the helmet accessory described above and the support system described above.

According to an embodiment, the support rail can be detachably fixed to the helmet. For example, the support rail can be slipped onto the bottom side of the helmet shell and/or clamped and/or screwed tightly on the helmet shell. According to another embodiment, the support rail can be fixed tightly to the bottom side of the helmet shell. For example, the support rail can be glued to the bottom side of the helmet shell. According to a further embodiment, the support rail can be configured integrally with the helmet or can be laminated or glued into the helmet.

BRIEF DESCRIPTION OF THE DRAWINGS

Further features will become apparent from the description of the embodiments together with the claims and the attached drawings. Embodiments may fulfill individual features or a combination of several features.

The embodiments will be described below without restricting the general inventive idea on the basis of exemplary embodiments with reference to the drawings, and regarding any details which are not explained further in the text reference is expressly made to the drawings. In the drawings.

In the drawings, the same or similar types of elements and/or parts are provided with the same reference numbers so that a corresponding re-introduction is omitted, respectively.

DETAILED DESCRIPTION

Figure 1:
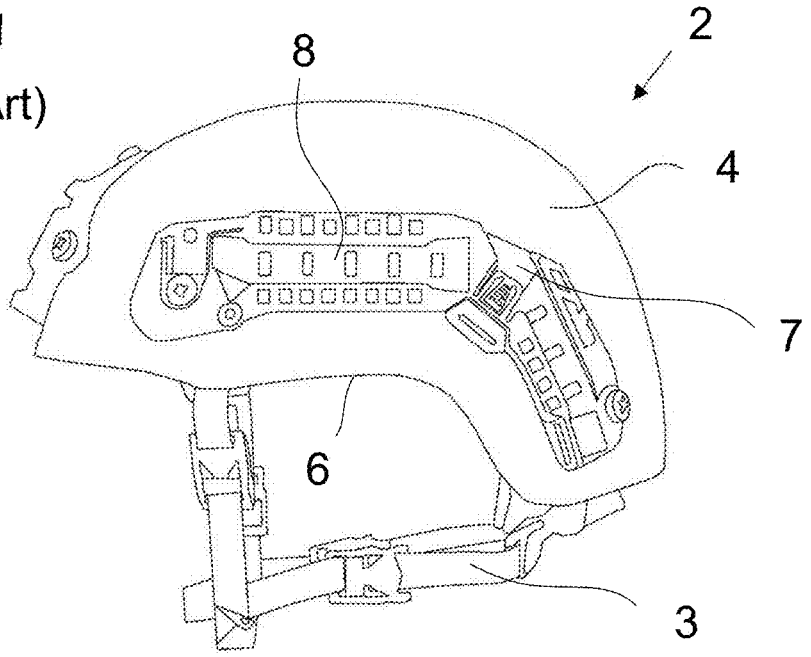
Fig. 1 (Prior Art)
FIG. 1 illustrates a schematically simplified illustration of a helmet with a support rail of the state of the art.
Figure 2:
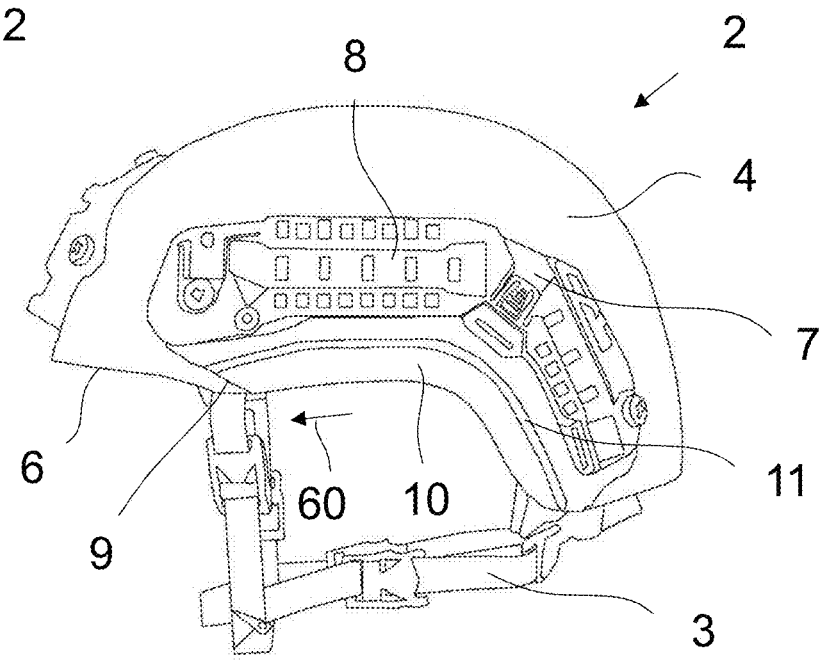
FIG. 2 illustrates a schematically simplified illustration of a helmet with a support rail with retaining groove.

FIG. 2 shows a schematically simplified helmet 2 which, in addition to the rail 7, comprises a support rail 9, which is attached to the bottom side 6, such as a lower edge, of the helmet shell 4. An outer side of the support rail 9 is configured as a first receiving side 10, in which a first retaining groove 11 is formed along a longitudinal direction 60. The longitudinal direction 60 extends from a rear end of the support rail 9 to a front end of the support rail 9 and thereby follows a curvature of the lower edge of the helmet shell 4.

The first retaining groove 11 offers a flexible solution for attachment of a hello met accessory to the helmet 2 that is easy to handle. A helmet accessory having matching engagement elements can be simply inserted into the first retaining groove 11, thereby enabling a quick and easy replacement of a helmet accessory. Due to the arrangement on the bottom side 6 of the helmet 2, the support rail 9 is also quickly and easily fixable to the helmet 2. For this purpose, the support rail 9 is, for example, clamped and/or glued on the lower edge of the helmet shell 4 in order to allow for secure abutting of the support rail 9.

Figure 3:
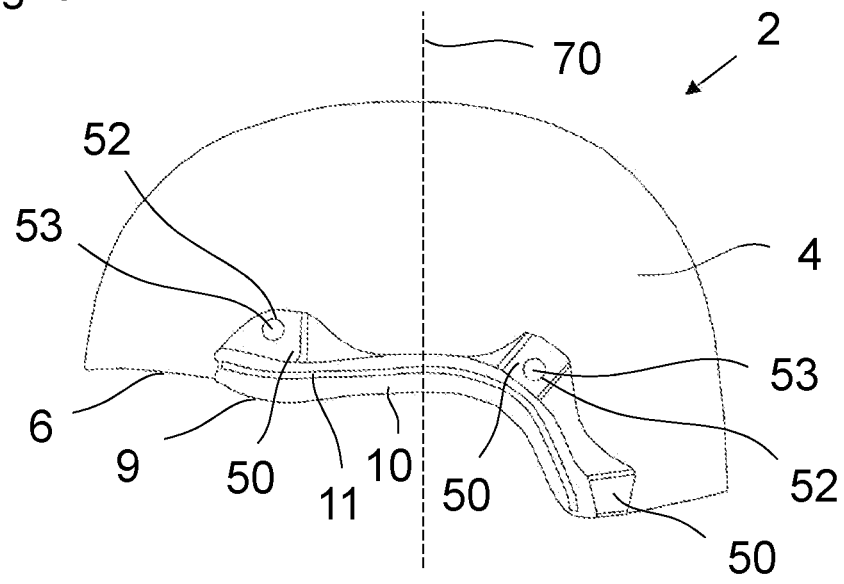
FIG. 3 illustrates a schematically simplified illustration of a helmet of a further embodiment of a support rail which is attached to the lower edge of the helmet shell.

FIG. 3 shows a further helmet 2 with a support rail 9, but without a rail 7. It can be seen in FIG. 3 that the embodiment of the support rail 9 shown in FIG. 3 has a plurality of abutting surfaces 50, which project from the support rail 9 and abut against the helmet shell 4. Bores 52 are introduced into two of these abutting surfaces 50, through which the support rail 9 can additionally be fixed to the helmet 2 by fixing elements 53, for example screws.

Figure 4:
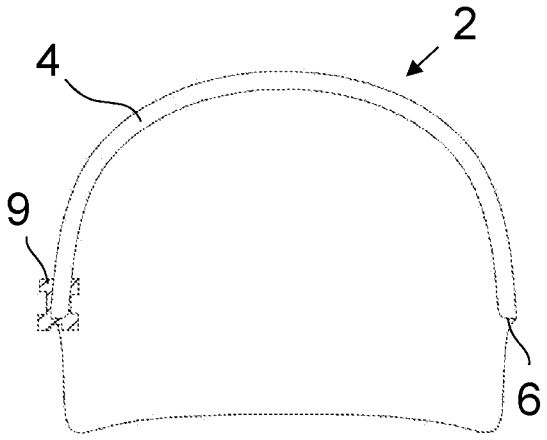
FIG. 4 illustrates a schematic simplified cross-sectional view through the helmet of FIG. 3.
Figure 5:
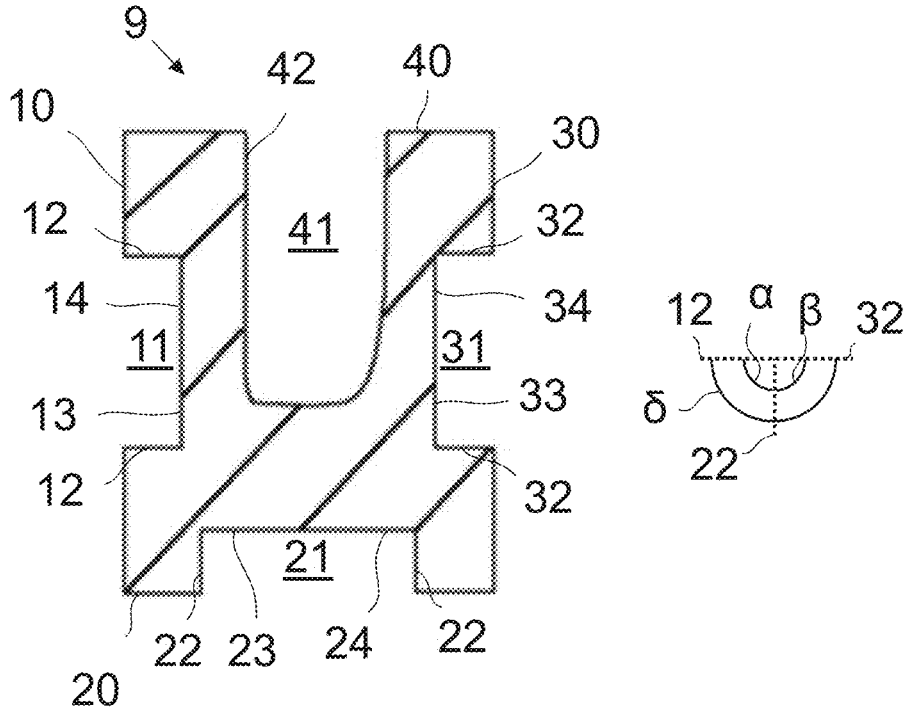
FIG. 5 illustrates a schematically simplified cross-sectional view through a support rail.

FIG. 4 shows a cross section through the helmet 2 and the support rail 9 along a cutting line 70 illustrated in FIG. 3. In this sectional illustration, it can be seen that the support rail 9 is slipped from below onto the bottom side 6 of the helmet shell 4. FIG. 5 shows an enlarged illustration of the cross-sectional view of the support rail 9. In FIG. 5 it becomes clear that the illustrated embodiment of the support rail 9 comprises on its top side 40 an attachment portion 42 in the form of an attachment groove 41 for receiving a lower edge of the helmet shell 4. The substantially rectangular cross-sectional area of the support rail 9 comprises three retaining grooves 11, 21, 31 which are introduced into a first receiving side 10, a second receiving side 20 and a third receiving side 30, respectively. Thereby, the first receiving side 10 is configured as an outer side, the second receiving side 20 as a bottom side and the third receiving side 30 as an inner side of the support rail 9. In the embodiment illustrated, each of the retaining grooves 11, 21, 31 comprises a rectangular cross section, so that they each comprise a groove base surface 13, 23, 33, and two groove side surfaces 12, 22, 32. The groove base surfaces 13, 23, 33 represent the groove valleys 14, 24, 34 of the retaining grooves 11, 21, 32 in the selected groove shape. Instead of rectangular retaining grooves 11, 21, 32, it is also possible, for example, to introduce triangular or curved or semicircular retaining grooves 11, 21 31 into the sides 10, 20, 30.

The groove side surfaces 12, 22, 32 extend in a line parallel to a first side of the first groove 11, a second side of the second groove 21 and a third side of the third retaining groove 31, respectively. FIG. 5 includes a diagram which illustrates the angle $\alpha$ between the first groove side surface 12 and the second groove side surface 22, the angle $\beta$ between the second groove side surface 22 and the third groove side surface 32 and the angle $\delta$ between the first groove side surface 12 and the third groove side surface 32. In the shown example the angles $\alpha$ and $\beta$ are 90° and the angle $\delta$ is 180°.

Due to the configuration of three retaining grooves 11, 21, 31 on the support rail 9, a helmet accessory can be attached flexibly and securely to the support rail 9 and thus to the helmet 2. For this purpose, the helmet accessory can be braced, for example, between two of the retaining grooves 11, 21, 31. The arrangement of the helmet accessory in the longitudinal direction 60 or the selection of the retaining grooves 11, 21, 31 is flexibly selectable.

Figure 6:
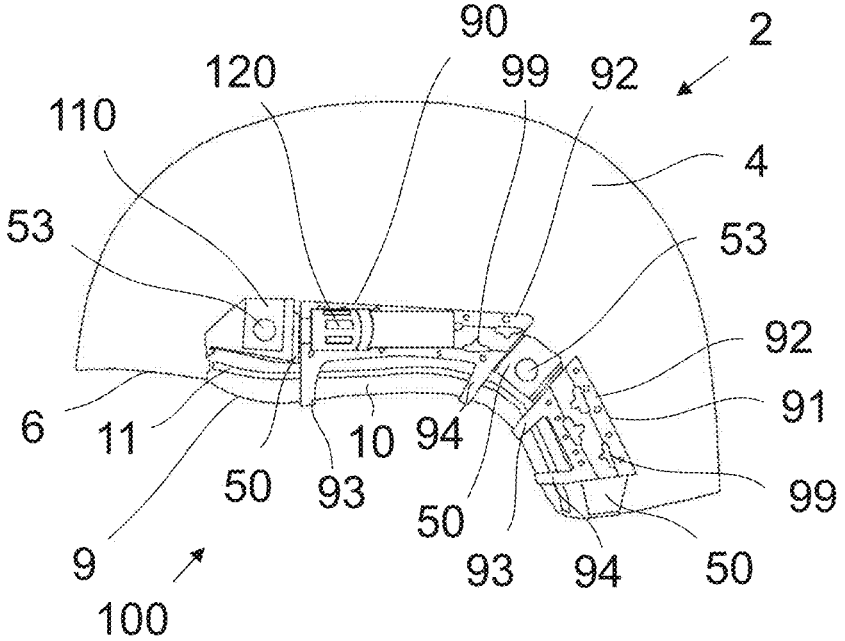
FIG. 6 illustrates a schematically simplified illustration of a helmet with a support rail and a helmet accessory.

FIG. 6 shows schematically simplified a helmet 2 with a support rail 9, to which helmet accessories 90, 91, 110, 120 are fixed. The helmet accessories 90 and 91 comprise supports for further helmet accessory 120, which comprises a lamp in the illustrated example. Each of the helmet accessories 90, 91 comprises respectively a retaining frame 92 and two retaining arms 93, 94. The retaining arms 93, 94 engage into the retaining grooves 11, 21, 31 of the support rail 9 and thus fix the helmet accessory 90, 91 on the helmet 2. Attachment elements 99 are provided on the retaining frame 92, on which said two retaining arms 93, 94 are arranged, by which said further helmet accessory 120 is fixed to the helmet 2.

The helmet accessory 110, configured as a visor receptacle, is another example of equipment which is fixed to the support rail 9. However, unlike the helmet accessory 90, 91, 120, the visor receptacle is not inserted into the retaining grooves 11, 21, 31 or fixed to the attachment elements 99, but is attached to the support rail 9 by said fixing element 53. The support rail 9 and one or more of the helmet accessories 90, 91, 110, 120 together form a support system 100 for attachment of the helmet accessory 90, 91, 110, 120 to the helmet 2.

Figure 7A:
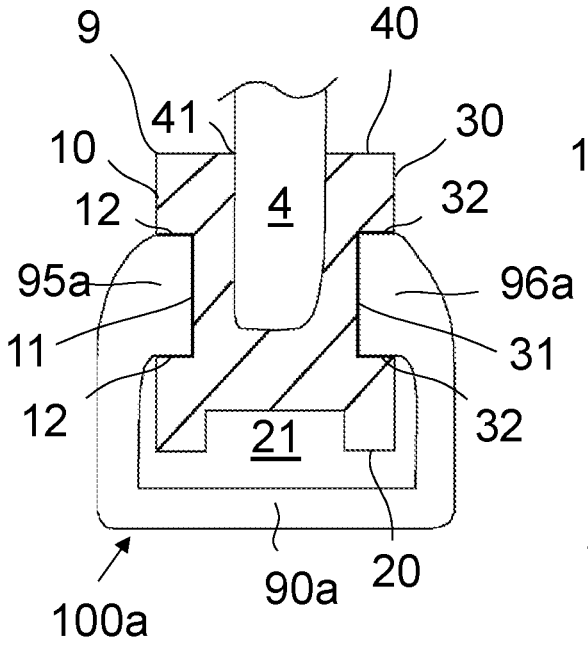
FIGS. 7*a*-7*c* illustrate schematically simplified cross-sectional views of a support rail with a helmet accessory.
Figure 7B:
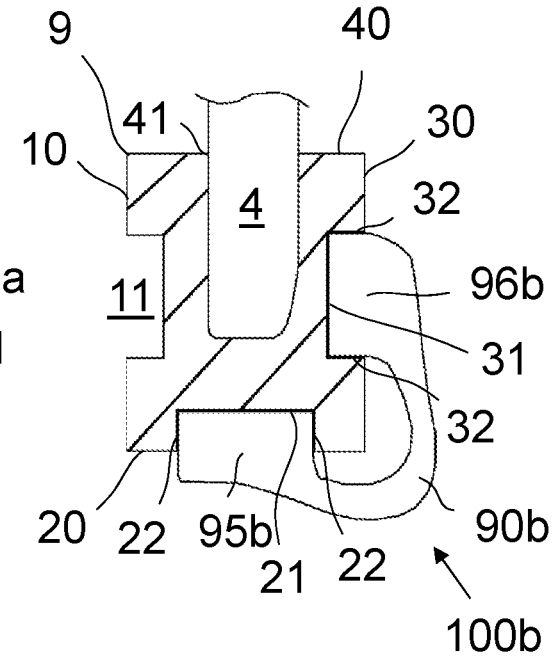
Figure 7C:
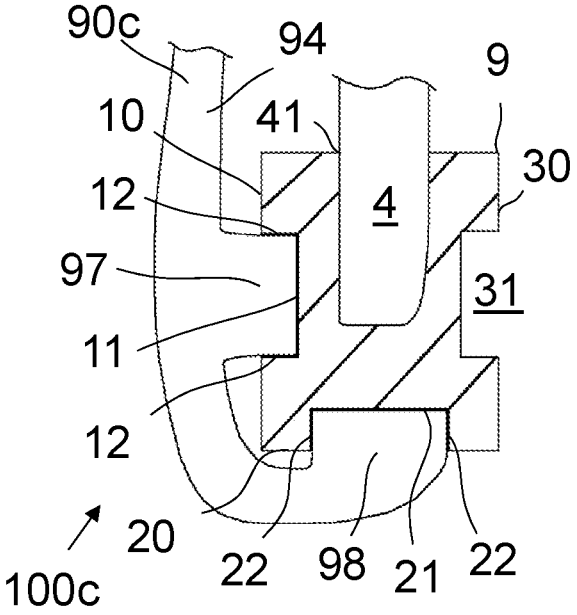

The FIGS. 7*a*, 7*b* and 7*c* show various embodiments of support systems 100*a*, 100*b*, 100*c*, respectively, in a cross-sectional view. As illustrated in FIG. 7*a*, the support rail 9 is fixed, for example glued, to a lower edge of the helmet shell 4 with the attachment portion 42 configured as attachment groove 41. A helmet accessory 90*a* is clamped in the first retaining groove 11 and the third retaining groove 31 by a first engagement element 95*a* and a second engagement element 96*a*. Due to the orientation and configuration of the retaining grooves 11, 31, the helmet accessory 90*a* is held securely on the support rail 9. For removal, one or both of the engagement elements 95*a*, 96*a* can simply be removed from the respective retaining groove 11, 31. In the exemplary embodiment shown, the engagement elements 95*a*, 96*a* are configured to be hook-shaped in order to be braced tightly and securely in the retaining grooves 11, 31.

The embodiment in FIG. 7*b* differs from the embodiment in FIG. 7*a* in that the helmet accessory is clamped in the second retaining groove 21 and the third retaining groove 31, thus through a right angle instead of through 180°. Due to the configured and shape of the retaining grooves 22, 32, the helmet accessory 90*b* is still held securely on the support rail 9 by a first engagement element 95*b* and a second engagement element 96*b*.

A further embodiment is shown in FIG. 7*c*. In this embodiment, the helmet accessory 90*c* is clamped by an engagement element 97 engaging in the first retaining groove 11 and an engagement element 98 engaging in the second retaining groove 21. In addition, a retaining arm 94 leads upward in order to connect the engagement elements 97, 98, for example, to a retaining frame 92 or another part of the helmet accessory 90*c*.

Figure 8A:
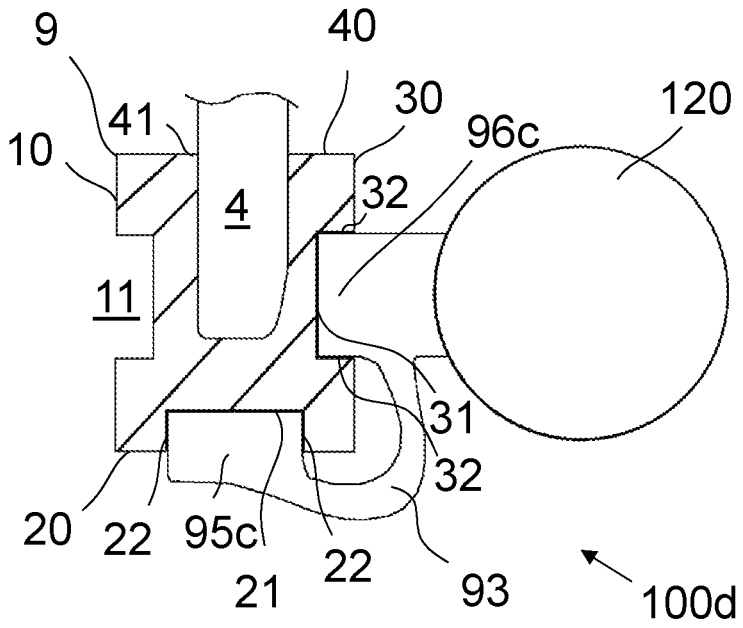
FIG. 8*a* illustrates a schematically simplified cross-sectional view of a helmet accessory configured as a lamp on a support rail.
Figure 8B:
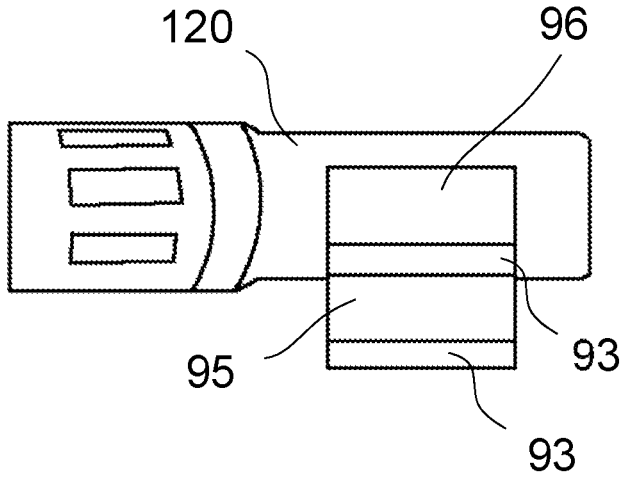
FIG. 8*b* illustrates a schematically simplified side view of the helmet accessory configured as a lamp.

FIGS. 8*a* and 8*b* show an embodiment of support system 100*d* with a helmet accessory 120 in the form of a lamp, which is configured with engagement elements 95*c*, 96*c* that are connected via a retaining arm 93. Therefore, the lamp can be clamped directly in the retaining grooves 21, 31 without the need for a retaining frame 92.

Figure 9:
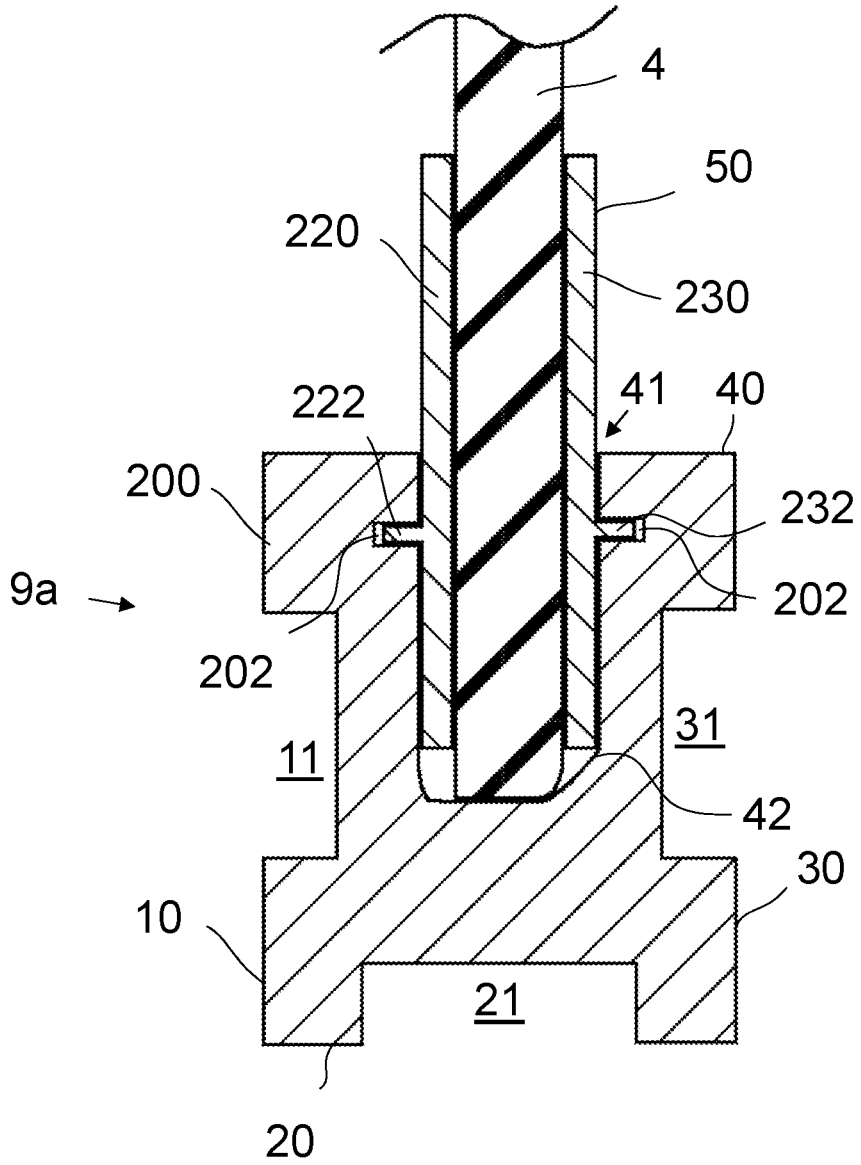
FIG. 9 illustrates a schematically simplified cross-sectional view through a support rail with a receiving component and two attachment components.

FIG. 9 shows an embodiment of a support rail 9*a*, which includes a receiving component 200 made of aluminum and two attachment components 220, 230 made of a hard plastic. The attachment components 220, 230 are arranged in said attachment portion 42 of the support rail 9*a* and extend upwards from there. For attachment to the receiving component 200, each of the attachment components 220, 230 comprises at least one stud 222, 232, which is inserted into form-fitting holes 202 of the receiving component 200.

The attachment components 220, 230 form partial portions of the walls of the attachment groove 41. Once the support rail 9*a* is slipped over the helmet shell 4, as shown in FIG. 9, the helmet shell 4 prevents the studs 222, 232 from detaching from the holes 204. If the support rail 9*a* is removed from the helmet shell 4, the studs 222, 232 can be detached from the holes 202 in order to separate the attachment components 220, 230 from the receiving component 230.

Since the attachment components 220, 230 are made of a plastic, they can be configured significantly thinner than components made of aluminum. For this reason, for example, the fastening component 230 abutting against the outer side of the helmet shell 4 can provide the abutting surface 50 for attachment of the support rail 9*a* to the helmet shell 4 (see FIG. 3). The fixing element 53 and the bore 52 are not shown in FIG. 9. In contrast, the attachment component 220 abutting against the inner side of the helmet shell 4 is configured to fix the helmet accessory in the interior of the helmet shell 4, for example upholstery, sensors or similar accessory.

While there has been shown and described what is considered to be embodiments of the invention, it will, of course, be understood that various modifications and changes in form or detail could readily be made without departing from the spirit of the invention. It is therefore intended that the invention be not limited to the exact forms described and illustrated, but should be constructed to cover all modifications that may fall within the scope of the appended claims.

LIST OF REFERENCE SIGNS

2 Helmet
3 Belt system
4 Helmet shell
6 Bottom side
7 Rail
8 Attachment elements
9, 9*a* Support rail
10 First receiving side
11 First retaining groove
12 Groove side surface
13 Groove base surface
14 Groove valley
20 Second receiving side
21 Second retaining groove
22 Groove side surface
23 Groove base surface
24 Groove valley
30 Third receiving side
31 Third retaining groove
32 Groove side surface
33 Groove base surface
34 Groove valley
40 Top side
41 Attachment groove
42 Attachment portion
50 Abutting surface
52 Bore
53 Fixing element
60 Longitudinal direction
70, 80 Cutting line
90*a*, 90*b*, 90*c*, Helmet accessory
91 Helmet accessory
92 Retaining frame
93, 94 Retaining arm
95*a*, 95*b*, 95*c* Engagement element
96*a*, 96*b*, 96*c* Engagement element
97 Engagement element
98 Engagement element
99 Attachment elements
100*a*, 100*b*, 100*c*, 100*d* Support system
110 Helmet accessory
120 Helmet accessory
200 Receiving component
202 Hole
220 First attachment component
222 Stud
230 Second attachment component
232 Stud

What is claimed is:

1. A support rail for attachment of a helmet accessory to a helmet, wherein the support rail comprising:

a top side;

a first receiving side;

a second receiving side; and a third receiving side;

wherein the top side has an attachment groove configured to be fixed to a bottom side edge of the helmet;

the first receiving side having a first retaining groove;

the second receiving side having a second retaining groove;

the third receiving side having a third retaining groove;

the first retaining groove, the second retaining groove and the third retaining groove are each configured to receive one or more engagement elements of a helmet accessory;

the attachment groove, a length of the first retaining groove, a length of the second retaining groove and a length of the third retaining groove each extend in a longitudinal direction of the support rail; and each of the first retaining groove, the second retaining groove and the third retaining groove having one or more sides terminating at a bottom surface.

2. The support rail according to claim 1, wherein the first retaining groove having a first bottom surface and a first side extending from the first receiving side to the first bottom surface;

the second retaining groove having a second bottom surface and a second side extending from the second receiving side to the second bottom surface; and a relative angle, in a plane perpendicular to the longitudinal direction, between a first line extending parallel to the first side of the first retaining groove and a second line extending parallel to the second side of the second retaining groove is in a range of 60° to 120°, inclusive of 60° and 120°.

3. The support rail according to claim 1, wherein the first retaining groove having a first bottom surface and a first side extending from the first receiving side to the first bottom surface;

the second retaining groove having a second bottom surface and a second side extending from the second receiving side to the second bottom surface;

the third retaining groove having a third bottom surface and a third side extending from the third receiving side to the third bottom surface; and a relative first angle, in a plane perpendicular to the longitudinal direction, between a second line extending parallel to the second side of the second retaining groove and a third line extending parallel to the third side of the third retaining groove is in a range of 60° to 120°, inclusive of 60° and 120°, and a relative second angle, in the plane perpendicular to the longitudinal direction, between a first line extending parallel to the first side of the first retaining groove and the third line extending parallel to the third side of the third retaining groove is in a range of 150° to 210°, inclusive of 150° and 210°.

4. The support rail according to claim 1, wherein the support rail comprises four or more sides along a transverse circumference, wherein each of the top side, the first receiving side and the second receiving side forms one of the four or more sides.

5. The support rail according to claim 1, wherein the support rail comprises four or more sides along a transverse circumference, wherein each of the top side, the first receiving side, the second receiving side and the third receiving side forms one of the four or more sides.

6. The support rail according to claim 1, wherein the first receiving side is an outer side and the second receiving side is a bottom side of the support rail.

7. The support rail according to claim 1, wherein the first receiving side is an outer side, the second receiving side is a bottom side and the third receiving side is an inner side of the support rail.

8. The support rail according to claim 1, further comprising at least one bore for receiving a fixing element, by which the support rail is fixable to the helmet.

9. The support rail according to claim 8, wherein the at least one bore is configured in an abutting surface which projects from the top side of the support rail and is configured to abut against an outer side of a helmet shell of the helmet.

10. The support rail according to claim 1, wherein the support rail includes a receiving component made of aluminum and at least one attachment component made of a plastic, wherein the first retaining groove and the second retaining groove are configured in the receiving component, wherein the attachment component is arranged in the attachment portion and fixed to the receiving component, wherein the attachment component extends upward from the receiving component.

11. The support rail according to claim 1, wherein the first retaining groove, the second retaining groove and the third retaining groove comprise:

a first bottom surface, a second bottom surface and a third bottom surface, respectively, and first parallel sides, second parallel sides and third parallel sides, respectively, extending from the first receiving side, the second receiving side and the third receiving side, respectively, to the first bottom surface, the second bottom surface and the third bottom surface, respectively.

12. The support rail according to claim 11, wherein the first bottom surface, the second bottom surface and the third bottom surface are perpendicular to the first parallel sides, the second parallel sides and the third parallel sides, respectively.

13. The support rail according to claim 11, wherein the first parallel sides and the third parallel sides are parallel to each other and the second parallel sides are perpendicular to each of the first parallel sides and the third parallel sides.

14. The support rail according to claim 13, wherein the first bottom surface and the third bottom surface are parallel to each other and the second bottom surface is perpendicular to each of the first bottom surface and the third bottom surface.

15. The support rail according to claim 1, wherein the attachment groove overlapping the first and third retaining grooves in a direction from the top side to the second receiving side.

16. A support system comprising:

the support rail according to claim 1; and a helmet accessory including a first retaining arm with a first engagement element configured to engage into one or more of the first retaining groove and the second retaining groove of the support rail;

wherein the helmet accessory is detachably fixable to the support rail by fixing the first engagement element in one or more of the first retaining groove and the second retaining groove.

17. A helmet comprising:

the support rail according to claim 1; and a helmet shell having the bottom side edge;

wherein the attachment groove of the support rail is fixed to the bottom side edge of the helmet shell.

* * * * *